US007759872B2

(12) United States Patent
Hosoya et al.

(10) Patent No.: US 7,759,872 B2
(45) Date of Patent: Jul. 20, 2010

(54) DISCHARGE LAMP

(75) Inventors: Shigeharu Hosoya, Himeji (JP); Hiroshi Kamiyama, Takasago (JP); Motohiro Sakai, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 175 days.

(21) Appl. No.: 11/067,951

(22) Filed: Mar. 1, 2005

(65) Prior Publication Data

US 2005/0194904 A1 Sep. 8, 2005

(30) Foreign Application Priority Data

Mar. 2, 2004 (JP) ..... 2004-057757

(51) Int. Cl.
*H01J 61/073* (2006.01)

(52) U.S. Cl. ..... 313/631; 313/632; 313/633; 313/491; 313/574

(58) Field of Classification Search ..... 313/631, 313/632, 633, 574, 491
See application file for complete search history.

(56) References Cited

U.S. PATENT DOCUMENTS 6,211,615 B1 * 4/2001 Altmann et al. ..... 313/631
6,683,413 B2 * 1/2004 Okubo et al. ..... 313/574

FOREIGN PATENT DOCUMENTS

JP 11102662 A * 4/1999
JP 2003223865 A * 8/2003
JP 2003-257363 9/2003

OTHER PUBLICATIONS

Machine translation of JP 11-102662 (Aug. 2003) provided in the non-final Mar. 21, 2007.*
Machine translation of JP 2003-223865 (Apr. 1999) provided in the non-final Mar. 21, 2007.*

* cited by examiner

*Primary Examiner*—Nimeshkumar D. Patel
*Assistant Examiner*—Anthony T Perry
(74) *Attorney, Agent, or Firm*—David S. Safran; Roberts Mlotkowski Safran & Cole, P.C.

(57) ABSTRACT

A discharge lamp in which fluctuation of the arc when the lamp starts and in which devitrification and damage of the arc tube are prevented, so that light intensity can be kept uniform over a long time is achieved by the cathode having a tapering part with a diameter which decreases in the direction to the tip that is formed with an area with different diameters extending around the tapering part in the peripheral direction which has concave-convex parts with groups of convex parts which are located next to one another in the axial direction of the cathode, the concave-convex parts in longitudinal cross section being arranged such that corner points of each convex part are located inside of an edge line of the tapering part, and an envelope curve which connects the corner points is convex with respect to the center line of the cathode.

9 Claims, 4 Drawing Sheets

DISCHARGE LAMP

BACKGROUND OF THE INVENTION

1. Field of the Invention

The invention relates to a discharge lamp, especially to a discharge lamp of the short arc type which is used, for example, as a light source in UV irradiation treatment in the photochemical industry, in semiconductor manufacture and the like or as a light source in projections, as in a projector or the like.

2. Description of the Prior Art

FIG. 5 is a front view which schematically shows the arrangement of one example of a conventional discharge lamp 40 of the short arc type. The discharge lamp 40 of the short arc type has a bulb 42 and an arc tube 41. An essentially oval discharge space S is formed in the bulb 42. The arc tube 41 has hermetically sealed portions 43 which border the two ends of this bulb 42 and which extend outward from it. In this arc tube 41, a cathode 44 and an anode 45 are arranged in opposed relationship. Furthermore, the arc tube 41 is filled with at least one rare gas in a suitable amount. The arc tube 41 is moreover filled, depending on the application of the lamp, with a suitable amount of mercury together with the rare gas. Here, the rare gases with which the arc tube 41 is filled can be, for example, xenon, krypton, argon and the like. A base 48 is located on the outer end of the respective hermetically sealed portion 43.

The cathode 44 has a tapering part 44A which is shaped essentially like a truncated cone, with a diameter which decreases in the direction to the tip end (anode side), and a body part 44B which borders this tapering part 44A extends to the rear in the axial direction, and for example, is cylindrical. The cathode 44 contains an emitter substance such as, for example, thorium or the like.

In such a discharge lamp of the short arc type 40, when the lamp is started, a high voltage, for example, from a few kV to a few dozen kV, is applied between the cathode 44 and the anode 45, by which an insulation breakdown takes place between the cathode 44 and the anode 45. Afterwards, a transition to an arc discharge takes place and the lamp is operated.

The discharge phenomenon when the lamp is started is described specifically below.

Immediately after the insulation breakdown between the cathode 44 and the anode 45 has taken place, an arc start point is formed on the tip surface 46 of the cathode 44. An arc is formed such that it extends in the axial direction between the cathode 44 and the anode 45. The reason for formation of the arc start point on the tip surface 46 of the cathode 44 is described below.

Because the cathode 44 has essentially the shape of a truncated cone in which the tapering part 44A is present and its diameter decreases in the direction to the tip end, an electrical field is concentrated on the tip area, especially on the edge area on the tip surface 46. In this way, the electrons in the tip area become free more easily. Furthermore, after the insulation breakdown has taken place and the arc has been formed, the cathode 44 reaches its highest temperature at its tip area. As becomes apparent from the Richardson-Dushmann equation, there is a tendency for the thermion emission capacity to increase exponentially according to the temperature increase. The electron emission capacity of the tip area becomes greater than in the other area of the cathode 44. For these and similar reasons, the arc start point is formed on the tip surface 46 of the cathode 44.

However, in a discharge lamp of the short arc type 40 with the above described arrangement, as is shown, for example, in FIG. 6, there is the case in which, when the lamp starts, the state in which the start point P of the arc A is formed on the tip surface 46 of the cathode 44 does not continue in a stable manner, but the start point is moved to a rear position in the axial direction—for example, to the surface position of the tapering part 44A which is away from the tip surface 45, to the surface position of the body part 44B or the like—and that it moves toward the tip side according to the temperature increase of the cathode 44. This means that it happens that the so-called fluctuation phenomenon of the arc A occurs.

When the start point P of the arc A is formed at the above described position, as was described above, the arc A is formed, for example, such that it extends in the manner of an arc along the inner surface of the arc tube 41. In this way, a state is obtained in which the arc A of the inner surface of the arc tube 41 is approached. Or, depending on the conditions of the arrangement and the operating conditions of the lamp, a state is obtained in which the arc A is in contact with the inner surface of the arc tube 41. As a result, the following disadvantages arise.

(1) The contact point of the arc A with the arc tube 41 is subject to devitrification. This reduces the light transmission factor of the arc tube 41. The intensity of the light which has been emitted from the discharge lamp of the short arc type 40 therefore becomes nonuniform. As a result, the illuminance on an article which is being irradiated with light becomes nonuniform. In the case, for example, of an application as a light source in the field of semiconductor exposure, the expected treatment cannot be reliably performed because nonuniform exposure takes place. In the case of use as a light source in the field of projection, an image with sufficient brightness cannot be provided.

(2) By contact or approach of the high temperature arc A, the inside surface of the arc tube 41 is quickly heated. This yields thermal distortion. As a result of this thermal distortion, the discharge lamp of the short arc type 40 is damaged.

The above described fluctuation phenomenon of the arc A occurs more and more distinctly in the course of repeated use of the lamp (on or off operation). The reasons for this are the following:

(1) During lamp operation, the tip area of the cathode 44 reaches a high temperature of, for example, roughly 2000° C. to 2500° C. The tip area melts, vaporizes and therefore deforms. The degree of concentration of the electrical field decreases.

(2) The emitter substance which is contained in the cathode 44 dries out in the course of repeated use of the lamp. The electron emission capacity of the tip area therefore decreases.

(3) The crystals of the tip area become coarser due to the thermal effect and the grain boundary between the crystals diminishes. In this way, the emitter substance is more poorly guided to the tip area and the electron emission capacity of the tip area decreases.

Various factors like these and similar reasons overall cause formation of the fluctuation phenomenon of the arc A, since the start point P of the arc A moves more often to a position outside of the tip area 46 of the cathode 44.

In view of this disadvantage, technology has been disclosed (see, for example, Japanese patent disclosure document 2003-257363) in which the following is done:

As is shown, for example, in FIG. 7, for the cathode 50 which has a tapering part 51 and a body 52 which borders this tapering part, in the tapering part 51, a concave part (concave part 55 in FIG. 7), a projection, or the like is formed. This concave part 55 or a projection prevents the start point of the arc from moving in the axial direction to behind the point at which the concave part 55 or the projection is formed. In this way, the formation of the fluctuation phenomenon of the arc and also devitrification or damage to the arc tube are prevented.

However, even when using the technology disclosed in JP-A-2003-257363, there are cases in which the arc start point passes beyond the point at the tapering part 51 of the cathode 50 at which, for example, the concave part 55 is formed, the arc start point moves, for example, to the surface position of the body 52 of the cathode 50, and at this point, the arc start point is formed. Therefore, there is the disadvantage that devitrification or damage to the arc tube as a result of the fluctuation phenomenon of the arc cannot be reliably prevented.

SUMMARY OF THE INVENTION

The invention was devised to eliminate the above described disadvantage in the prior art. Thus, a primary object of the invention is to devise a discharge lamp in which the formation of the fluctuation phenomenon of the arc when the lamp starts can be reliably prevented, in which, thus, devitrification and damage of the arc tube can be prevented, in which, therefore, the amount of reduction of the light intensity can be kept low, and in which light with a uniform intensity can be reliably obtained over a long time.

The object is achieved in accordance with the invention in a discharge lamp which has an arc tube in which a discharge space is formed and in which a cathode and anode are arranged opposed relationship, in that the cathode has a tapering part with a diameter which decreases in the direction to the tip, that, in this tapering part, an area with different diameters is formed which has concave-convex parts which are formed of groups of convex parts which are located next to one another in the axial direction of the cathode, over the entire periphery in the peripheral direction, that the concave-convex parts, in cross section including the middle axis of the cathode, are arranged such that the corner point of the respective convex part is located on the inside, starting from the edge line of this tapering part, and that, moreover, the envelope curve which connects the respective corner point is convex with respect to the center line of the cathode.

Furthermore, the object is advantageously achieved in a discharge lamp in accordance with the invention in that, in the area with different diameters for the cathode, concave-convex parts are formed at two points at positions which are away from one another in the axial direction.

ACTION OF THE INVENTION

In the discharge lamp of the invention, the cathode has a tapering part with a diameter which decreases in the direction to the tip. In this tapering part, an area with different diameters is formed which has concave-convex parts with a certain shape over the entire periphery in the peripheral direction of the cathode. By this measure, the electrical field when the lamp starts can be concentrated on the concave-convex parts by the arrangement of the concave-convex parts in themselves, which form the area with different diameters, and by the arrangement of the entire area with different diameters, even if the lamp is repeatedly turned on and off and thus the electron emission capacity in the tip area of the cathode is reduced. There, the start point of the arc formed between the cathode and anode can be reliably prevented from moving in the axial direction to behind this area with different diameters. In this way, formation of the fluctuation phenomenon of the arc can be reliably prevented and as a result, devitrification or damage to the arc tube can be prevented. Therefore, light with a uniform intensity can be reliably emitted over a long time.

Furthermore, by the arrangement in which, in the area with the different diameters for the cathode, the concave-convex parts can be formed at two points at positions which are away from one another in the axial direction, the above described action can be even more reliably achieved.

The invention is further described below with reference to the accompanying drawings.

DETAILED DESCRIPTION OF THE INVENTION

Figure 1:
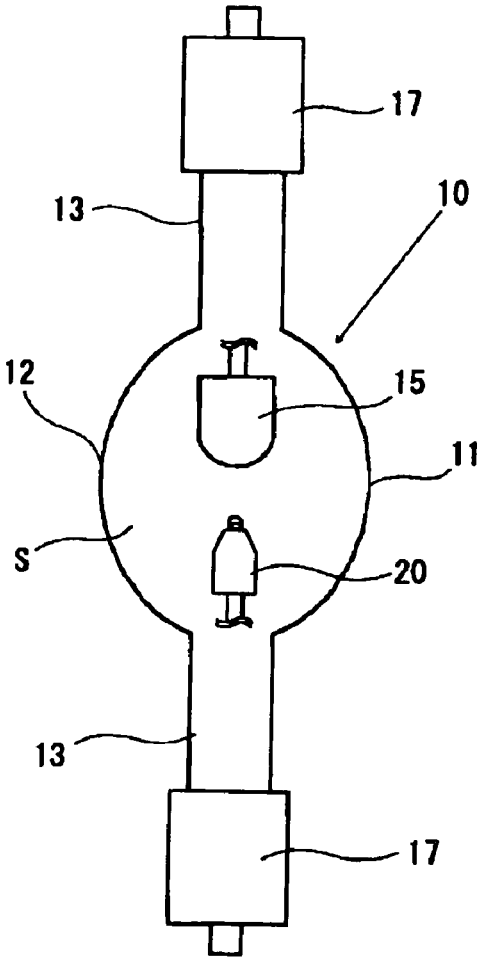
FIG. 1 schematically shows a front view of the arrangement of one example of a discharge lamp of the short arc in accordance with the invention.
Figure 2:
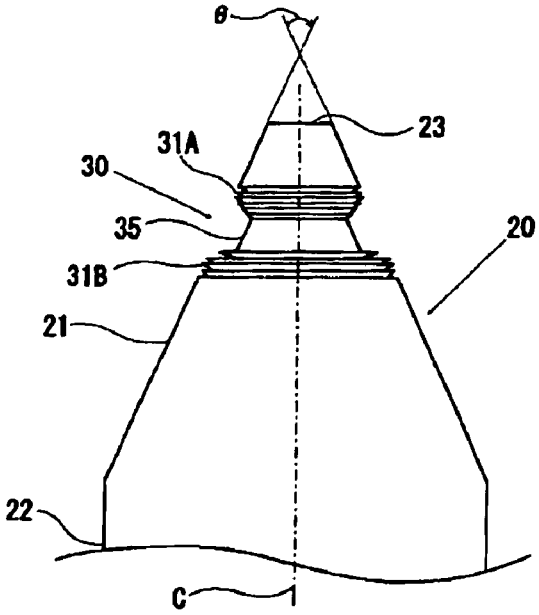
FIG. 2 is a schematic elevational view of the arrangement of the cathode of the discharge lamp of the short arc type shown in FIG. 1 in an enlargement, FIG. 3 schematically shows an enlarged cross section of important parts of the cathode of FIG. 2.
Figure 3:
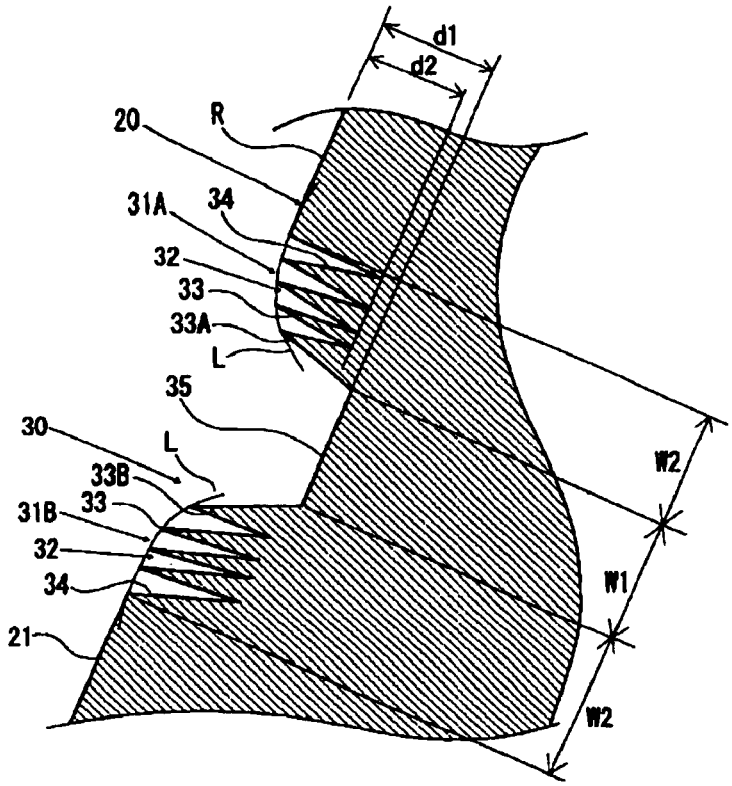

The discharge lamp of the short arc type 10 has an arc tube 11 which has a bulb 12 which forms, for example, an essentially oval discharge space S, and hermetically sealed portions 13 which border the two ends of this bulb 12 and which extend outward. In this arc tube 11, there is a pair of opposed electrodes, i.e., a cathode 20 and an anode 15, each of which is formed, for example, of tungsten. Moreover, at least one rare gas such as, for example, xenon gas or the like, is contained in the arc tube 11 in a suitable amount. Furthermore, the arc tube 11 is filled, depending on the application of the lamp, with a suitable amount of mercury together with the rare gas. Here, the rare gas with which the arc tube 11 is to be filled is not limited to xenon gas, but argon, krypton, or other rare gases which are conventionally advantageously used can be used. A base 17 is located on the outer end of each hermetically sealed portion 13.

The tip area of the anode 15 has, for example, an essentially hemispherical shape because the electrons which have been emitted from the cathode 20 can thus be captured with high efficiency. The cathode 20 has a tapering part 21 which has the shape of a truncated cone, for example, with a diameter which decreases in the direction toward the tip end, and a cylindrical body part 22 which borders this tapering part 21 and extends to the rear.

In this discharge lamp of the short arc type 10, in the tapering part 21 of the cathode 20, an area with different diameters 30 is formed over the entire periphery in the peripheral direction.

Specifically, the area with different diameters 30 of the cathode 20 is arranged as follows:

There are, for example, two sawtoothed concave-convex parts 31A, 31B at two points, which are formed of groups 32 of convex parts which are arranged next to one another in the axial direction of the cathode 20, in the cross section which includes the center axis C of the cathode 20, the corner point of each convex part 33, viewed from the edge line R of the tapering part 21, is positioned on its inner side, and the envelope curve L which connects the respective corner points is convex with respect to the center line C of cathode 20.

There is a smooth part 35 with an end bordering the convex part 33A on the back end of the arrangement of the convex part 33 of the concave-convex part 31A viewed from the tip, with its other end moreover bordering the convex part 33B on the outermost front end of the arrangement of the convex parts 33 of the concave-convex part 31B on the side of the back end and with a surface which is essentially smooth.

The area with different diameters 30 is therefore arranged such that the concave-convex parts 31A, 31B, which each have a certain shape and which are located at two points that are separated from one another in the axial direction by the smooth part 35.

The area with the different diameters 30 of the cathode 20 can be formed, for example, as follows.

At a given point in the tapering part 21 of the cathode 20, an annular groove part (concave part) is formed with a cross section which is essentially trapezoidal and which extends over the entire periphery in the peripheral direction of the cathode 20, for example, using a grinder or the like. In the respective edge area of this annular groove part—in other words, in areas which contain the boundary lines between the surface of the tapering part 21 and the inclined planes of the annular groove part—concave parts 34 are formed so as to extend over the entire periphery in the circumferential direction, for example, by laser machining or the like, of annular grooves with a, for example, essentially V-shaped cross section having a smaller pitch than the annular groove parts. In this way, the bottom of the annular groove part is made as a smooth part 35, and moreover, concave-convex parts 31A, 31B are formed at two points which are spaced apart from one another at opposite sides of this smooth part 35. Thus, an area with different diameters 30 with a given shape is formed. Here, the convex part 33A, which is formed on the back end for the concave-convex part 31A on the tip side, is arranged using the inclined plane of the annular groove part. The annular groove with the V-shaped cross section which is located on the last end is formed, in practice, in the vicinity of the edge area of the annular groove part. This also applies to the concave-convex part 31B on the side of the rear electrode tip end. The convex part 33B which is formed on the outermost tip is arranged using the inclination of the annular groove part.

The depth d1 of the smooth part 35 which forms the area with different diameters 30, proceeding from the surface (edge line) of the tapering part 21 and the depth d2 of the respective concave part 34 for the concave-convex parts 31A, 31B which form the area with different diameters 30, can be set according to the conditions of arrangement and the operating conditions of the lamp in a suitable manner as long as they have magnitudes at which a heating surface can be ensured which is large enough to prevent melting of the tip area.

It is advantageous for the point at which the area with different diameters 30 in the tapering part 21 is formed to be at a point as near as possible to the tip area where a heating surface with a sufficient size is ensured for the area with different diameters 30.

The numerical values in the discharge lamp of the short arc type 10 with the above described arrangement are shown below.

The maximum outside diameter of the arc tube 11 is 45 mm to 300 mm;

the internal volume of the arc tube 11 is 40 $cm^3$ to 16000 $cm^3$;

the distance between the cathode 20 and the anode 15 is 3.5 mm to 50 mm;

the total length (length in the axial direction) of the tapering part 21 of the cathode 20 is 3 mm to 55 mm;

the tip angle of the tapering part 21 of the cathode 20 (tapering angle) $\theta$ is 30° to 80°;

the total length of the body part 22 of the cathode 20 is 1 mm to 100 mm;

the diameter of the body part 22 of the cathode 20 is 5 mm to 30 mm;

the depth d1 of the smooth part 35 which forms the area with different diameters 30, proceeding from the surface of the tapering part 21, is 0.3 mm to 3 mm;

the width W1 of the smooth part 35 which forms the area with different diameters 30 (length in the axial direction along the surface of the tapering part 21) is 0.3 mm to 15 mm;

the depth d2 of the concave part 34, 34 of the concave-convex parts 31A, 31B which form the area with different diameters 30 is 0.2 mm to 2 mm;

widths W2, W2 of the concave-convex parts 31A, 31B which form the area with different diameters 30 is 0.3 mm to 10 mm;

the number of convex parts 33 in the concave-convex parts 31A, 31B is at least 3 and the pitch between the corner points of the adjacent convex parts 33 is 0.1 mm to 0.4 mm.

In the case of use as a light source in the field of projection, the amount of added rare gas is fixed to a pressure in the range from 0.1 MPa to 4 MPa at a reference temperature of 300 K. In the case of use as a light source in the field of semiconductor production, the added amount of rare gas is fixed at a pressure in the range from 0.01 MPa to 1 MPa at a reference temperature of 300 K, and the amount of added mercury is 1 $mg/cm^3$ to 100 $mg/cm^3$.

In a discharge lamp of the short arc type 10 with the above described arrangement, the cathode 20 has a tapering part 21 with a diameter which decreases in the direction toward the tip. In the tapering part 21, over the entire periphery in the circumferential direction of the cathode 20, an area with different diameters 30 is formed in which at two different locations concave-convex parts 31A, 31B are formed at a certain distance from one another, separated by a by a smooth part 35. By this measure, an area with a discontinuous field strength is formed in which the continuity of the field strength is interrupted. Thus, the effect of concentration of the electrical field by the annular concave part with a relatively great width which forms the smooth part 35, and the effect of concentration of the electrical field by the concave-convex parts 31A, 31B which have annular grooves with a smaller width than this annular groove part are obtained.

This means that there is an arrangement in which the degree of concentration of the electrical field of the concave-convex parts 31A, 31B which form the area with different diameters 30 is increased. Moreover the smooth part 35 is formed with a greater width than the annular grooves which form the concave-convex parts 31A, 31B, i.e. with a large distance of movement which is required for the passage of the arc start point, bordering the concave-convex part 31A on the tip side. Therefore the arc start point which has moved away from the tip surface 23 can be allowed to remain temporarily in the concave-convex part 31A on the tip side.

Figure 7:
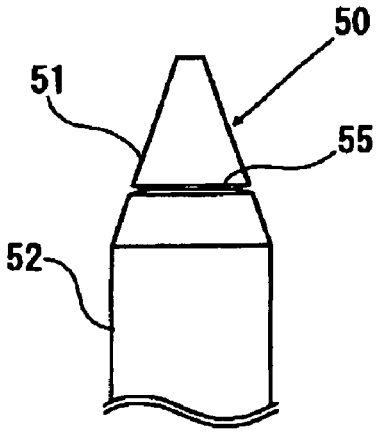
Fig. 7 (Prior Art)
FIG. 7 is a schematic elevational view of the arrangement of the cathode of another example of a conventional discharge lamp of the short arc type.

For the cathode 50 with the arrangement shown, for example, in FIG. 7, when an arrangement is provided in which simply several annular grooves with the same shape are located next to one another in the axial direction, only the effect of concentration of the electrical field is produced by the individual annular groove parts regardless of the effect by the other annular groove parts. However, the ability to prevent the movement of the arc starting point is not achieved. In contrast, with the invention, the movement of the arc start point in the axial direction to behind the point on which the part with different diameters 30 is formed can be prevented with certainty and the arc starting point can be quickly moved to the tip surface 23 of the cathode 20 according to the temperature increase of the tip area of the cathode 20. In this way, the formation of the fluctuation phenomenon of the arc can be prevented with certainty and devitrification or damage of the arc tube 11 as a result of the fluctuation phenomenon of the arc can be prevented with certainty. Therefore, light with a uniform intensity can be emitted with certainty over a long time.

The above described action can be furthermore obtained even more reliably by the arrangement in which in the area with different diameters 30 for the cathode 20, concave-convex parts 31A, 31B with a certain shape are formed at two points that are a distance from one another across the smooth part 35.

One embodiment of the lamp unit of the invention was described above. However, the invention is not limited to the above described version, and various changes can be made.

Figure 4:
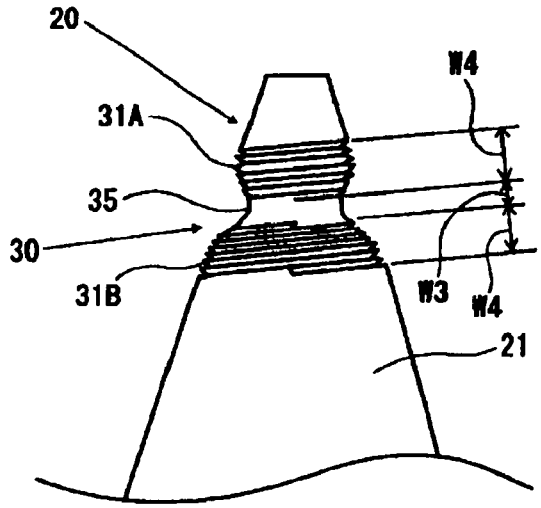
FIG. 4 is a schematic elevational view of another example of the arrangement of the cathode of the discharge lamp of the short arc type according to the invention.
Figure 5:
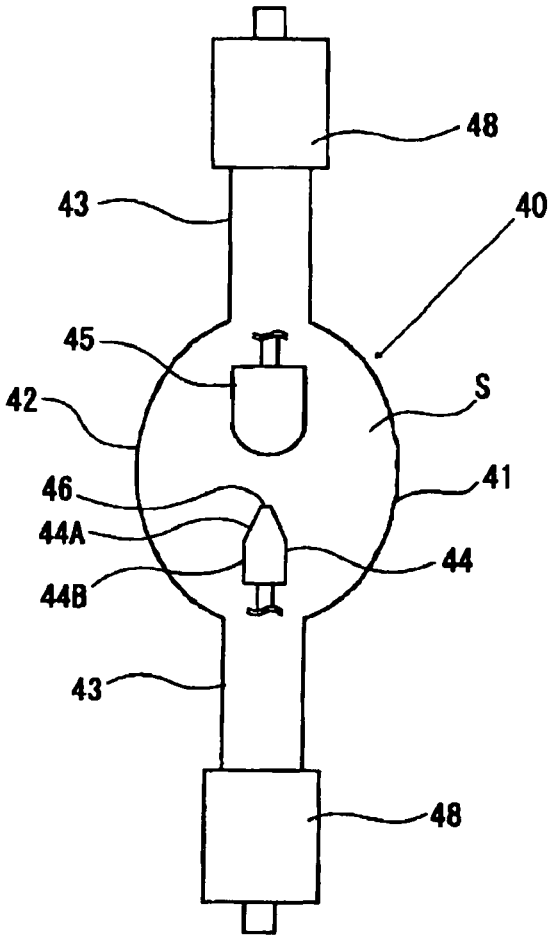
Fig. 5 (Prior Art)
FIG. 5 is a schematic elevational view which shows the arrangement of one example of a conventional discharge lamp of the short art type, FIG. 6 schematically shows the state in which, when the lamp starts, the arc start point is formed at a location which has been moved away from the tip surface of the cathode.

The shape of the concave-convex parts which form the area with the different diameters in the cathode and the shape of the smooth part are, for example, not especially limited, but the concave-convex parts 31A, 31B which form the areas with the different diameters 30 can also be formed with helical grooves, such as shown, for example, in FIG. 4. Furthermore, the smooth part 35 can be made curved instead of flat. In practice, an adequate effect can also be obtained by these arrangements.

It is sufficient if the smooth part which forms the area with different diameters constitutes an area with a field strength which is discontinuous relative to the field strength of the areas provided with the concave-convex parts. In the smooth part, annular grooves or projections which extend in the peripheral direction can also be formed.

It is not necessary for the concave-convex parts which form the area with the different diameters to be formed at two locations. It is sufficient if they border at least the tip end of the cathode in the smooth part.

Experimental examples which were carried out for confirming the action of the invention are described below. However, the invention is not limited to these examples.

Production Example 1 of a Lamp of the Short Arc Type

According to the arrangement shown in FIG. 1, a discharge lamp of the short arc type of the invention was produced. This discharge lamp of the short arc type is called "lamp A" below and the specific arrangement of this lamp A and its specifications are described as follows:

Arc tube (11): maximum outside diameter 100 mm
internal volume: 600 $cm^3$

Cathode (20): material: thoriated tungsten containing thorium as the emitter substance Total length (length in the axial direction) of the tapering part (21): 15.6 mm Tip angle (θ) of the tapering part: 60°

Total length of the body part (22): 34.4 mm

Diameter of the body part: 20 mm

Arrangement of the area with different diameters (30): sawtoothed concave-convex part (31A, 31B) at two points are formed at a distance from one another over the smooth part (35).

Position at which the concave-convex part (31A) is formed on the tip side: the point which is located 2 mm behind the tip surface of the cathode with respect to the axial direction.

Surface shape of the smooth part which forms the area with the different diameters: flat Depth (d1) of the smooth part proceeding from the surface of the tapering part: 0.5 mm Width (W1) of the smooth part: 1.7 mm Shape of the respective concave-convex part which forms the area with the different diameters: annular groove with a V-shaped cross section Depth (d2) of the respective concave part (34) of the concave-convex part: 0.5 mm Width (W2) of the respective concave-convex part: 1.2 mm Number of convex parts (33) in the concave-convex parts: 6

Pitch between the corner points of the adjacent convex parts (33) for the concave-convex parts: 0.15 mm Anode (15): maximum outside diameter: 30 mm Total length: 50 mm Distance between the cathode (20) and the anode (15): 10 mm Added gas: xenon gas Added gas pressure: $0.90\times10^5$ Pa Amount of mercury: 20 $mg/cm^3$ Input wattage: 10 kW Lamp voltage in the stable state (at the start): 90 V

Production Example 2 of a Lamp of the Short Arc Type

A discharge lamp of the short arc type of the invention with the same arrangement as lamp A was produced, aside from the use of a cathode with the arrangement described below (see FIG. 4) for the lamp A which has been obtained in the above described production example 1. This discharge lamp of the short arc type is called "lamp B" below, and the arrangement of the cathode in this lamp B is described as follows:

Arrangement of the area with different diameters (30): sawtoothed concave-convex parts (31A, 31B) at two points are formed at a distance from one another over the smooth part (35).

Position at which the concave-convex part (31A) is formed on the tip side: a point which is located 2 mm behind the tip surface of the cathode with respect to the axial direction.

Surface shape of the smooth part which forms the area with the different diameters: spherical Maximum depth of the smooth part proceeding from the surface of the tapering part: 0.6 mm Width (W3) of the smooth part: 0.6 mm Shape of the respective concave-convex parts which form the area with the different diameters: helical grooves with a V-shaped cross section Number of convex parts (33) for the concave-convex parts: 6

Pitch between the corner points of the adjacent convex parts for the concave-convex parts: 0.15 mm Depth of the respective concave part (34) of the concave-convex parts: 0.5 mm Width (W4) of the respective concave-convex part: 0.9 mm Production Example 3 of a Lamp of the Short Arc Type A discharge lamp of the short arc type was produced for comparison purposes with the same arrangement as lamp A, aside from the use of a cathode with the arrangement described in FIG. 7 for the lamp A which was obtained in the above described production example 1. This discharge lamp of the short arc type is called "lamp C" and the arrangement of the cathode in this lamp C is described as follows:

Shape of the concave part (55): annular groove with a trapezoidal cross section Position at which the concave part is formed: the point which is 2 mm behind the tip surface of the cathode with respect to the axial direction Depth of the concave part: 0.5 mm Width of the concave part: 0.15 mm Production Example 4 of a Lamp of the Short Arc Type A discharge lamp of the short arc type was produced for comparison purposes with the same arrangement as lamp A, aside from the use of a cathode for the lamp A obtained in the above described production example 1 with an arrangement in which there is no area with different diameters. This discharge lamp of the short arc type is called "lamp D" below. The dimensions of the tapering part and the dimensions of the body part of the cathode in this lamp D are identical to the size of the lamp A.

Test Example

Figure 6:
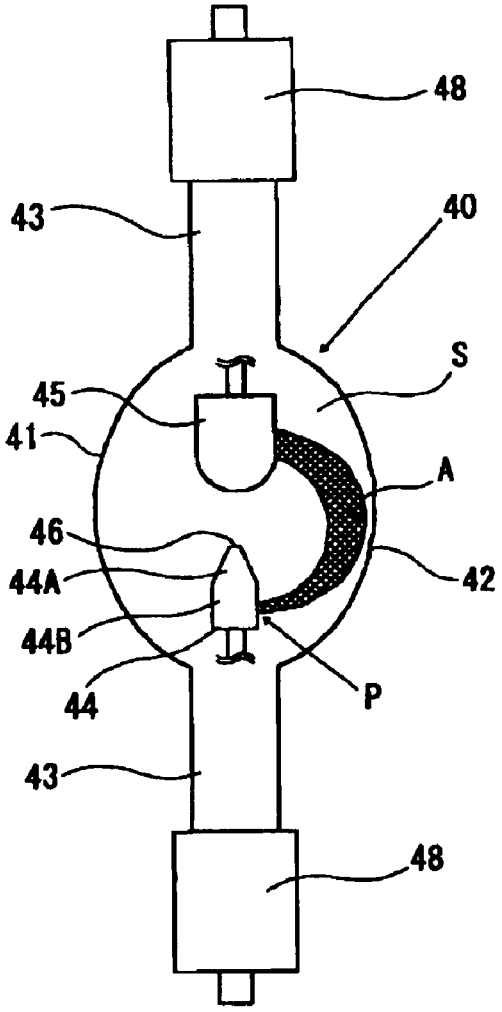
Fig. 6 (Prior Art)

A test in which the above described lamps A to D are each operated for six hours without interruption and are turned off afterwards for two hours, was repeated 150 times. At the instant at which this test had been run for the 50th time, at the instant at which this test had been run for the 100th time, and at the instant at which this test had been run for the 150th time, the frequency of formation of the fluctuation phenomenon of the arc when the lamp was started was visually confirmed. Moreover, at the instant at which this test had been run for the 50th time, at the instant at which this test had been run for the 100th time, and at the instant at which this test had been run for the 150th time, it was visually confirmed whether devitrification of the arc tube had occurred or not. The result is shown below using Table 1. Here, the phrase "frequency of formation of the fluctuation phenomenon of the arc" is defined as the counted frequency with which the start point of the arc has moved from the tip surface of the cathode to the surface position of the bottom part of the cathode when the lamp is started (for example, the frequency with which the state shown in FIG. 6 is occurs).

TABLE 1

| | Test frequency (number) | Frequency of formation of the fluctuation phenomenon of the arc (total) | Formation of Devitrification of the arc tube (yes or no) |
|---|---|---|---|
| Lamp A | 50 | 0 | No |
| | 100 | 0 | No |
| | 150 | 0 | No |

TABLE 1-continued

| | Test frequency (number) | Frequency of formation of the fluctuation phenomenon of the arc (total) | Formation of Devitrification of the arc tube (yes or no) |
|---|---|---|---|
| Lamp B | 50 | 0 | No |
| | 100 | 0 | No |
| | 150 | 0 | No |
| Lamp C | 50 | 0 | No |
| | 100 | 3 | No |
| | 150 | 11 | Yes |
| Lamp D | 50 | 2 | No |
| | 100 | 13 | Yes |
| | 150 | 59 | Yes |

As was described above, for the lamps a and b in accordance with the invention the following was confirmed:

The formation of the fluctuation phenomenon of the arc is prevented with certainty.

The formation of devitrification of the arc tube as a result of the fluctuation phenomenon of the arc is prevented with certainty.

Therefore the desired efficiency of the lamp over a long time can be obtained.

For comparison purposes, conversely, the following was confirmed in the lamps C and D:

The frequency of formation of the fluctuation phenomenon of the arc increases according to the increase in the frequency of on or off operation of the lamp (test frequency).

Devitrification of the arc tube arises in the lamp C at the instant after the 150th test.

Devitrification of the arc tube arises in the lamp D at the instant after the 100th test.

What we claimed is:

1. Discharge lamp, comprising:

an arc tube in which a discharge space is formed and in which a cathode and anode are arranged in opposition to each other, the cathode having a tapering part in the shaped of a truncated cone having a circumferential surface with a diameter which decreases in a direction to a tip end of the truncated cone, wherein at least one area of the tapering part is provided with concave-convex parts, the concave-convex parts being formed of a plurality of separate convex parts having adjoining end points which are connected to each other such that adjacent sides of the convex parts form concave parts, the concave-convex parts extending around the entire circumferential surface of the tapering part at a distance from the tip end of the truncated cone, and wherein the tapering part is provided with an annular groove, the annular groove being formed in part by the concave-convex parts, wherein the annular groove, in cross section, has a bottom surface that is one of flat, concavely curved and grooved, wherein a cross section of the tapering part which includes a center axis of the cathode is such that corner points of the convex parts of the concave-convex parts are located on an envelope curve that is convex with respect to the center axis of the cathode and that curves inward from the circumferential surface of the truncated cone in a direction towards the center axis of the tapering part and toward the bottom surface of said annular groove.

2. Discharge lamp as claimed in claim 1, wherein at least two areas of the cathode are provided with said concave-convex parts, said areas being spaced apart from one another in the axial direction of the cathode with said annular groove disposed therebetween.

3. Discharge lamp as claimed in claim 2, wherein the envelope curve of the two areas of the cathode provided with said concave-convex parts which are spaced apart from one another curve inward toward each other from the circumferential surface of the tapering part.

4. Discharge lamp as claimed in claim 2, wherein the convex parts have an essentially triangular cross section.

5. Discharge lamp as claimed in claim 1, wherein the convex parts have an essentially triangular cross section.

6. Discharge lamp as claimed in claim 1, wherein said bottom surface is flat.

7. Discharge lamp as claimed in claim 1, wherein said bottom surface is concavely curved.

8. Discharge lamp, comprising:

an arc tube in which a discharge space is formed and in which a cathode and anode are arranged in opposition to each other, the cathode having a tapering part in the shaped of a truncated cone with a circumferential surface having diameter measured from a center axis of the cathode which decreases in a direction to a tip end of the truncated cone, wherein at least one area of the tapering part is provided with a plurality of separate convex parts connected at end points of adjacent convex parts other such that adjacent sides of the convex parts form concave parts, the convex parts extending around the entire circumferential surface of the tapering part at a distance from the tip end of the truncated cone, wherein a cross section of the tapering part which includes a center axis of the cathode is such that corner points of the convex parts are located on an envelope curve that is convex with respect to the center axis of the cathode and that curves inward in a direction towards the center axis from the circumferential surface of the tapering part, wherein there are two areas of the cathode provided with said convex parts which are spaced apart from one another and the envelope curves thereof curve inward toward each other from the circumferential surface of the tapering part, wherein the two areas of the cathode convex parts are separated from one another by a circumferentially extending groove which has a width in a direction parallel to the center axis that is greater than the width of each of the convex parts in said direction parallel to the center axis.

9. Discharge lamp as claimed in claim 8, wherein the depth of the concave parts of the spaced apart areas relative to the surface of the tapering part in which they are formed is less than the depth of said groove relative to the surface of the tapering part.

* * * * *